US012702170B2

(12) United States Patent
Fard et al.

(10) Patent No.: US 12,702,170 B2
(45) Date of Patent: Aug. 11, 2026

(54) APPARATUS AND METHOD FOR LOCATION MONITORING OF A NETWORK-ENABLED SMOKING SUBSTITUTE DEVICE

(71) Applicant: Imperial Tobacco Limited

(72) Inventors: Daniel Fard, Liverpool (GB); Oliver Talbot, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 563 days.

(21) Appl. No.: 17/001,861

(22) Filed: Aug. 25, 2020

(65) Prior Publication Data

US 2021/0068467 A1 Mar. 11, 2021

Related U.S. Application Data

(63) Continuation of application No. PCT/EP2019/053499, filed on Feb. 13, 2019.

(30) Foreign Application Priority Data

Feb. 26, 2018 (GB) ..... 1803029

(51) Int. Cl.
*A24F 40/65* (2020.01)
*A24F 40/10* (2020.01)
(Continued)

(52) U.S. Cl.
CPC ..... *A24F 40/65* (2020.01); *A24F 40/53* (2020.01); *A24F 40/60* (2020.01); *A24F 40/10* (2020.01)

(58) Field of Classification Search
CPC ..... A24F 40/65; A24F 40/53; A24F 40/60
See application file for complete search history.

(56) References Cited

U.S. PATENT DOCUMENTS

2015/0181945 A1* 7/2015 Tremblay ..... A24F 40/60 131/328
2016/0164973 A1 6/2016 Kapoor
(Continued)

FOREIGN PATENT DOCUMENTS

WO WO 2014/121578 8/2014
WO WO 2016/123307 8/2016

OTHER PUBLICATIONS

International Search Report, mailed Apr. 26, 2019, in PCT/EP2019/053499, filed Feb. 13, 2019.
(Continued)

*Primary Examiner* — Christopher M Rodd
*Assistant Examiner* — Jennifer A Kessie
(74) *Attorney, Agent, or Firm* — Dykema Gossett PLLC

(57) ABSTRACT

The present disclosure relates to a technique that utilizes the ability of a smoking substitute device to wirelessly connect via a wireless personal area network to a portable communication terminal (e.g. mobile phone) to provide a user with location-related information about the smoking substitute device. The technique may be used to issue a notification upon detection a dropped connection, e.g. to prevent loss or theft of the smoking substitute device. The technique may use other information from the smoking substitute device and/or portable communication terminal to judge whether or not a dropped connection is notifiable. For example, notifications may be suppressed based on any of a duration of the loss of the wireless connection, a presence of a wireless connection between the portable communication terminal and another smoking substitute device, a current location of the portable communication terminal, and historical smoking substitute device usage data.

6 Claims, 6 Drawing Sheets

(51) Int. Cl.
*A24F 40/53* (2020.01)
*A24F 40/60* (2020.01)

(56) References Cited

U.S. PATENT DOCUMENTS

| | | | | |
|---|---|---|---|---|
| 2016/0219933 | A1 | 8/2016 | Henry, Jr. et al. | |
| 2017/0014582 | A1 | 1/2017 | Skoda | |
| 2017/0092106 | A1 | 3/2017 | Cameron | |
| 2019/0357598 | A1* | 11/2019 | Qiu ..... | A61B 5/682 |

OTHER PUBLICATIONS

Written Opinion of the International Searching Authority, mailed Apr. 26, 2019, in PCT/EP2019/053499, filed Feb. 13, 2019.

* cited by examiner

APPARATUS AND METHOD FOR LOCATION MONITORING OF A NETWORK-ENABLED SMOKING SUBSTITUTE DEVICE

CROSS-REFERENCE TO RELATED APPLICATIONS/INCORPORATION BY REFERENCE STATEMENT

The present patent application is a continuation of International Application No. PCT/EP2019/053499, filed Feb. 13, 2019; which claims priority to the patent application identified by GB Serial No. 1803029.6, filed on Feb. 26, 2018. The entire contents of each of the above-referenced patent(s)/patent application(s) are hereby expressly incorporated by reference herein.

TECHNICAL FIELD

The present disclosure relates to smoking substitute devices. In particular, it relates to a network-enabled smoking substitute device, i.e. a smoking substitute device capable of wireless communication with other devices, e.g. over a short range network.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices may comprise electronic systems that permit a user to simulate the act of smoking by producing an aerosol, also referred to as a "vapour," that is drawn into the lungs through the mouth (inhaled) and then exhaled. The inhaled aerosol typically bears nicotine and/or flavourings without, or with fewer of, the odor and health risks associated with traditional smoking.

In general, smoking substitute devices are intended to provide a substitute for the rituals of smoking, whilst providing the user with a similar experience and satisfaction to those experienced with traditional smoking and tobacco products.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilising a different smoking substitute approach. A smoking substitute approach corresponds to the manner in which the substitute system operates for a user.

One approach for a smoking substitute device is the so-called "vaping" approach, in which a vapourisable liquid, typically referred to (and referred to herein) as "e-liquid," is heated by a heating device to produce an aerosol vapour which is inhaled by a user. An e-liquid typically includes a base liquid as well as nicotine and/or flavourings. The resulting vapour therefore typically contains nicotine and/or flavourings.

The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapour") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapour which is inhaled by a user through the mouthpiece.

Another example vaping smoking substitute device is the blu PRO™ e-cigarette. The blu PRO™ e-cigarette is an open system device which includes a main body, a (refillable) tank, and a mouthpiece. The main body and tank are physically and electrically coupled together by screwing one to the other. The mouthpiece and refillable tank are physically coupled together by screwing one of the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapour which is inhaled by a user through the mouthpiece.

Another approach for a smoking substitute device is the so-called "heat not burn" ("HNB") approach in which tobacco (rather than e-liquid) is heated or warmed to release vapour. The tobacco may be leaf tobacco or reconstituted tobacco. The vapour may contain nicotine and/or flavourings. In the HNB approach the intention is that the tobacco is heated but not burned, i.e. does not undergo combustion.

A typical HNB smoking substitute device may include a main body and a consumable. The consumable may include the tobacco material. The main body and consumable may be configured to be physically coupled together. In use, heat may be imparted to the tobacco material by a heating device that is typically located in the main body, wherein airflow through the tobacco material causes moisture in the tobacco material to be released as vapour. A vapour may be formed from a carrier in the tobacco material (this carrier may for example include propylene glycol and/or vegetable glycerin) and additionally volatile compounds released from the tobacco. The released vapour may be entrained in the airflow drawn through the tobacco.

As the vapour passes through the smoking substitute device (entrained in the airflow) from an inlet to a mouthpiece (outlet), the vapour cools and condenses to form an aerosol (also referred to as a vapour) for inhalation by the user. The aerosol will normally contain the volatile compounds.

In HNB smoking substitute devices, heating as opposed to burning the tobacco material is believed to cause fewer, or smaller quantities, of the more harmful compounds ordinarily produced during smoking. Consequently, the HNB approach may reduce the odor and/or health risks that can arise through the burning, combustion and pyrolytic degradation of tobacco.

An example of the HNB approach is the IQOS™ smoking substitute device from Philip Morris Ltd. The IQOS™ smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapour and flavourings which may be drawn through the mouthpiece by the user through inhalation.

A second example of the HNB approach is the device known as "Glo"™ from British American Tobacco p.l.c. Glo™ comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapour and flavourings which may be drawn through the consumable by the user through inhalation. The tobacco, when heated by the heating device, is configured to produce vapour when heated rather than when burned (as in a smoking apparatus, e.g. a cigarette). The tobacco may contain high levels of aerosol formers (carrier), such as vegetable glycerine ("VG") or propylene glycol ("PG").

The present inventor(s) have observed that most smoking substitute devices currently on the market are configured to operate in isolation of other devices, which limits the functions the smoking substitute devices can perform.

The present disclosure has been devised in light of the above considerations.

BRIEF DESCRIPTION OF THE DRAWINGS

Embodiments and experiments illustrating the principles of the present disclosure will now be discussed with reference to the accompanying figures in which:

FIG. 2(*b*) shows the main body of the smoking substitute device of FIG. 2(*a*) without the consumable.

FIG. 2(*c*) shows the consumable of the smoking substitute device of FIG. 2(*a*) without the main body.

FIG. 3(*b*) is a schematic view of the consumable of the smoking substitute device of FIG. 2(*a*).

DETAILED DESCRIPTION

Figure 1:
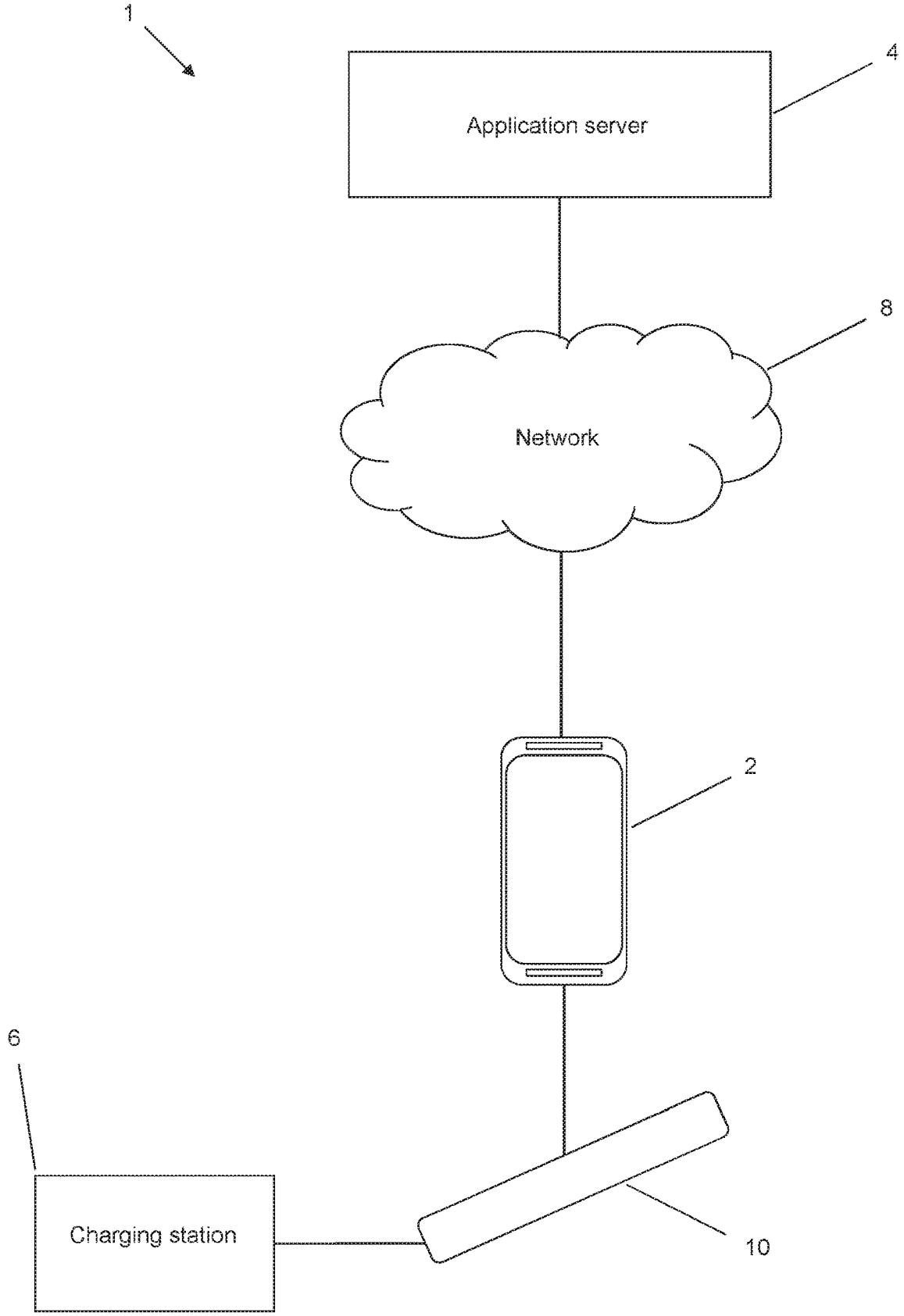
FIG. 1 shows an example system for managing a smoking substitute device.

At its most general, the present disclosure utilizes the ability of a smoking substitute device to wirelessly connect to a portable communication terminal (e.g. mobile phone) to provide a user with location-related information about the smoking substitute device. In one example, this ability may manifest as a loss or heft prevention technique, e.g. based on detecting a dropped connection between the smoking substitute device and the portable communication terminal which indicates that they are no longer located together. In another example, this ability may make use of location-tracking functionality on the portable communication terminal and usage data from the smoking substitute device to make more sophisticated or user-tailored judgements.

According to one non-limiting aspect of the present disclosure, there is provided a computer-implemented method for monitoring a location of a smoking substitute device, the method comprising: issuing, by a portable communication terminal, a dropped connection notification upon loss of a wireless connection between the portable communication terminal and the smoking substitute device.

The smoking substitute device may resemble any of the smoking substitute devices discussed above further comprising a wireless interface for establishing and communicating over the wireless communication channel between the smoking substitute device and a portable communication terminal. The wireless interface may utilities any suitable wireless protocol. For example, the wireless interface may operate over a short range network. For example, it may comprise a wireless personal area network (WPAN), e.g. using Bluetooth™, ZigBee, a WiFi personal hotspot or the like. The smoking substitute device may pair with the portable communication terminal over the wireless communication channel. The portable communication terminal may be a master device and the smoking substitute device may be a slave device.

The portable communication terminal may be any communications device capable of wireless interaction with the smoking substitute device, e.g. of over a short range network. The portable communication terminal may be a mobile phone (e.g. smartphone), tablet computer, laptop computer, or the like.

The method may comprise detecting, by the portable communication terminal, the loss of the wireless connection. This may be done in any conventional manner. For example, the portable communication terminal may be arranged to poll the smoking substitute device on a regular (e.g. periodic) basis. The loss of the wireless connection may be detected as a failure to receive a response the polling. Alternatively or additionally, the smoking substitute device may be configured to transmit data (e.g. usage data) to the portable communication terminal on a regular (e.g. periodic) basis. The loss of the wireless connection may be detected as an absence of these transmissions for a predetermined period.

The method may include determining, by the portable communication terminal, whether or not the loss of the wireless connection is notifiable. The step of issuing the dropped connection notification may be arranged to occur upon determining that the loss of the wireless connection is notifiable. If the loss of the wireless connection determined to be not notifiable, the dropped connection notification may be suppressed Herein, the functions performed by the portable communication terminal may be done locally, e.g. using a processor and memory in the portable communication terminal itself, or at a remote application server (e.g. in the cloud), which is in networked communication with the portable communication terminal. The network communication between the portable communication terminal and the application server may be separate or independent of the wireless communication channel between the smoking substitute device and the portable communication terminal. The network communication may comprise a connection over the world wide web. The network communication may utilize a cellular network or a WiFi network, for example.

Communication between the portable communication terminal and the application server may be controlled by a app running on the portable communication terminal. The app may run in the background on the portable communication terminal to handle communication with the smoking substitute device.

The step of determining whether or not the loss of the wireless connection is notifiable may comprise determining whether or not one or more notification suppression criteria are fulfilled. The notification suppression criteria may relate to any one or any combination of: a duration of the loss of the wireless connection; a presence of a wireless connection between the portable communication terminal and another smoking substitute device; a current location of the portable communication terminal; and historical smoking substitute device usage data. By enabling suppression of the notification in certain scenarios, the method may prevent unnecessary or unwanted notifications from being issued. This is beneficial in terms or avoiding wasting power and processing resources on unwanted message, but also in terms of notifications, when actually issued, being more likely to be effective because the user is not in the habit of ignoring them.

In one example, the method may include obtaining, from a location tracking unit of the portable communication terminal, a current location of the portable communication terminal; comparing the obtained current location with a stored list of locations at which notifications are to be suppressed; and determining that the loss of the wireless connection is not notifiable if the current location matches a location on the stored list. The stored list may be user adjustable. This enables the user to set "safe" locations, e.g. home or workplace, where the smoking substitute device can disconnect from the portable communication terminal without alarm.

In another example, the method may include obtaining, from a location tracking unit of the portable communication terminal, a current location of the portable communication terminal upon detecting the loss of the wireless connection; comparing the obtained current location with a map of historical usage locations; and determining that the loss of the wireless connection is notifiable if the current location matches a location on the map of historical usage locations. In this example, historical usage of the smoking substitute device is used to determine whether or not a notification is warranted.

The map of historical usage locations may be assembled from data received at or otherwise obtained by the portable communication terminal. For example, before the loss of the wireless connection, the method may include: obtaining, by the portable communication terminal, usage data from the smoking substitute device; obtaining, from the location tracking unit of the portable communication terminal, location information corresponding to the usage data; creating, by the portable communication terminal, the map of historical usage locations using the usage data and the corresponding location information.

The dropped connection notification may be any suitable message or prompt. Issuing the notification may comprises generating a visible, audible or tactile output on the portable communication device. The nature of the notification may be selectable by the user, e.g. via the app running on the portable communication terminal.

In another non-limiting aspect, the present disclosure may provide an apparatus for monitoring a location of a smoking substitute device, the apparatus comprising a portable communication terminal configured to communicate with the smoking substitute device via a wireless communication channel, wherein the portable communication terminal is configured to issue a dropped connection notification upon loss of a wireless connection between the portable communication terminal and the smoking substitute device.

In yet another non-limiting aspect, the present disclosure may comprise a computer program product comprising a computer-readable storage medium having computer-readable instructions stored thereon, wherein the computer-readable instructions are executable as an app in a portable communication terminal to perform the method of monitoring a location of a smoking substitute device disclosed above.

The present disclosure includes the combination of the aspects and particular features described except where such a combination is clearly impermissible or expressly avoided.

Aspects and embodiments of the present disclosure will now be discussed with reference to the accompanying figures. Further aspects and embodiments will be apparent to those skilled in the art. All documents mentioned in this text are incorporated herein by reference.

FIG. 1 shows an example system 1 for managing a smoking substitute device 10.

The system 1 as shown in FIG. 1 includes a mobile device 2, an application server 4, an optional charging station 6, as well as the smoking substitute device 10.

The smoking substitute device 10 is configured to communicate wirelessly, e.g. via Bluetooth™, with an application (or "app") installed on the mobile device 2, e.g. via a suitable wireless interface (not shown) on the mobile device 2. The mobile device 2 may be any portable communication terminal capable of running an app, such as a mobile phone or smartphone, a tablet computer, or a laptop computer, for example. The application on the mobile phone is configured to communicate with the application server 4, via a network 8. The application server 4 may utilize cloud storage, for example.

The network 8 may include a cellular network and/or the internet.

A skilled person would readily appreciate that the mobile device 2 may be configured to communicate via the network 8 according to various communication channels, such as (but not limited to) a wireless communication channel such as via a cellular network (e.g. according to a standard protocol, such as 3G or 4G) or via a WiFi network.

The app installed on the mobile device and the application server 4 may be configured to assist a user with their smoking substitute device 10, based on information communicated between the smoking substitute device 10 and the app and/or information communicated between the app and the application server 4.

The charging station 6 (if present) may be configured to charge (and optionally communicate with) the smoking substitute device 10, via a charging port on the smoking substitute device 10. The charging port on the smoking substitute device 10 may be a USB port, for example, which may allow the smoking substitute device to be charged by any USB-compatible device capable of delivering power to the smoking substitute device 10 via a suitable USB cable (in this case the USB-compatible device would be acting as the charging station 6). Alternatively, the charging station could be a docking station specifically configured to dock with the smoking substitute device 10 and charge the smoking substitute device 10 via the charging port on the smoking substitute device 10.

Figure 2A:
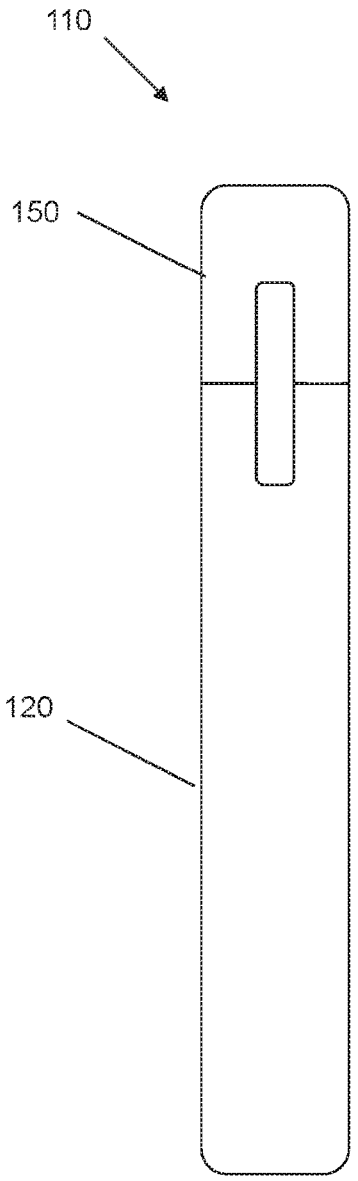
FIG. 2(*a*) shows an example smoking substitute device for use as the smoking substitute device in the system of FIG. 1.
Figure 2B:
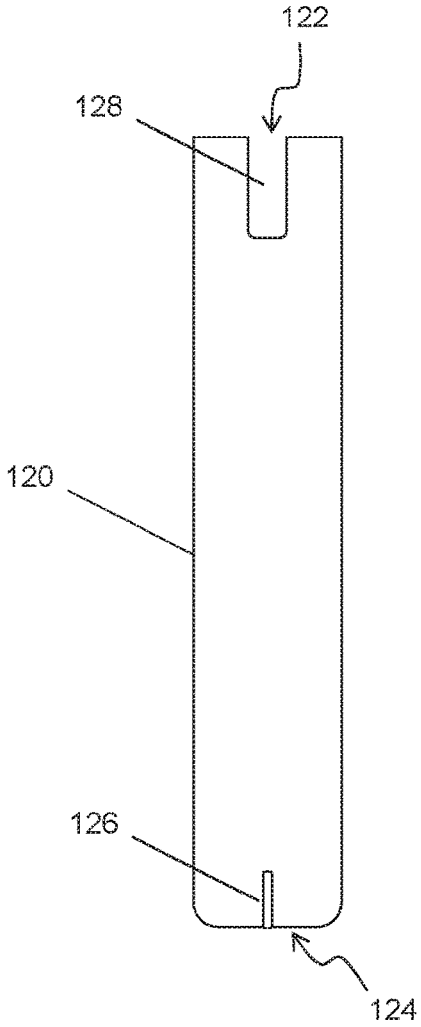
Figure 2C:
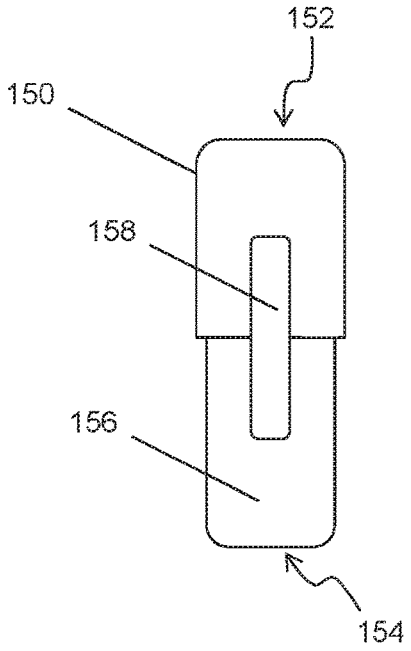

FIG. 2(*a*) shows an example smoking substitute device 110 for use as the smoking substitute device 10 in the system 1 of FIG. 1.

In this example, the smoking substitute device 110 includes a main body 120 and a consumable 150. The consumable 150 may alternatively be referred to as a "pod."

In this example, the smoking substitute device 110 is a closed system vaping device, wherein the consumable 150 includes a sealed tank 156 and is intended for one-use only.

FIG. 2(*a*) shows the smoking substitute device 110 with the main body 120 physically coupled to the consumable 150.

FIG. 2(*b*) shows the main body 120 of the smoking substitute device 110 without the consumable 150.

FIG. 2(*c*) shows the consumable 150 of the smoking substitute device 110 without the main body 120.

The main body 120 and the consumable 150 are configured to be physically coupled together, in this example by pushing the consumable 150 into an aperture in a top end 122 of the main body 120. In other examples, the main body 120 and the consumable could be physically coupled together by screwing one onto the other, or through a bayonet fitting, for example. An optional light 126, e.g. an LED located behind a small translucent cover, is located a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIG. 2) so that air can be drawn into the smoking substitute device 110 when a user inhales through the mouthpiece. At a bottom end 154 of the consumable 150, there is located a tank 156 that contains e-liquid. The tank 156 may be a translucent body, for example.

In certain non-limiting embodiments, the tank 156 includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

The tank 156 may be referred to as a "clearomizer" if it includes a window 158, or a "cartomizer" if it does not.

Figure 3A:
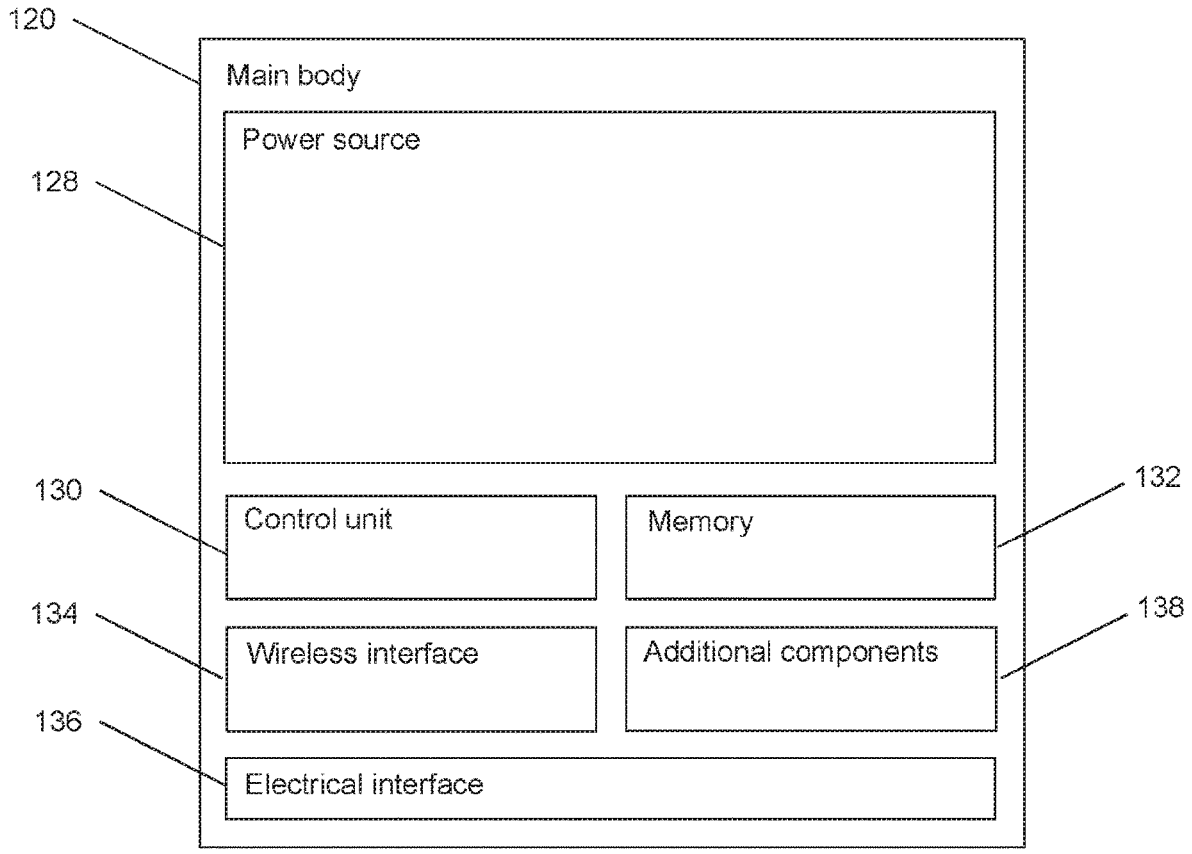
FIG. 3(*a*) is a schematic view of the main body of the smoking substitute device of FIG. 2(*a*).
Figure 3B:
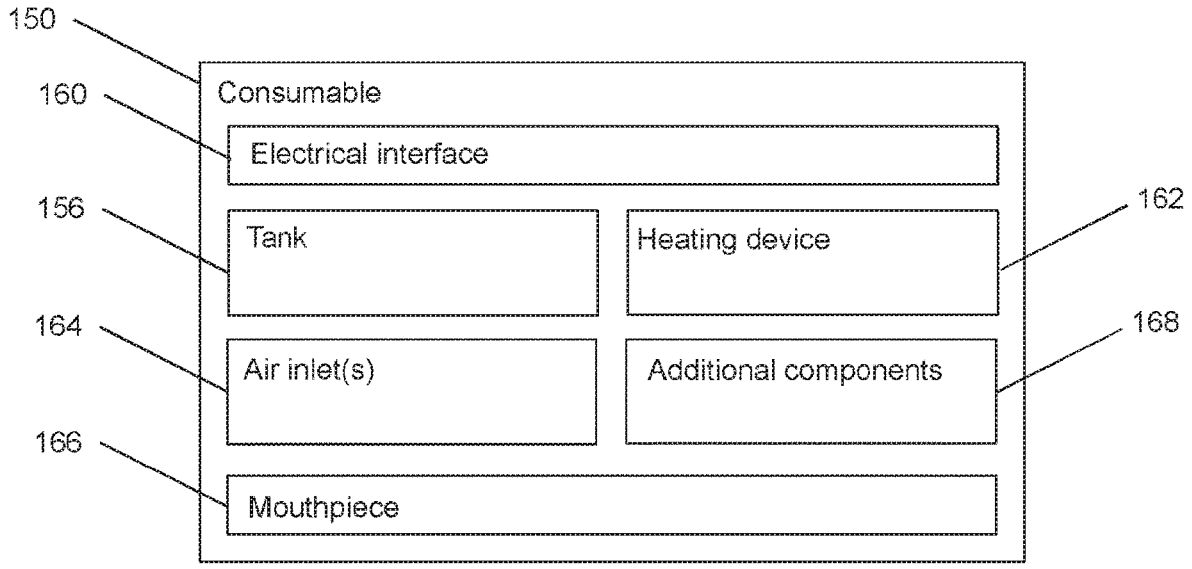

FIG. 3(*a*) is a schematic view of the main body 120 of the smoking substitute device 110.

FIG. 3(*b*) is a schematic view of the consumable 150 of the smoking substitute device 110.

As shown in FIG. 3(*a*), the main body 120 includes a power source 128, a control unit 130, a memory 132, a wireless interface 134, an electrical interface 136, and, optionally, one or more additional components 138.

In certain non-limiting embodiments, the power source 128 is a battery, such as (but not limited to) a rechargeable battery.

The control unit 130 may include a microprocessor, for example.

The memory 132 may include non-volatile memory for storing computer readable instructions which, when executed, control operation of the device. In this example, the computer readable instructions may operate to establish and maintain connectivity with a mobile device as discussed in more detail below.

In certain non-limiting embodiments, the wireless interface 134 is configured to communicate wirelessly with the mobile device 2 via a short range wireless network, e.g. a wireless personal area network (WPAN). The wireless interface 134 may be incorporate any suitable short-distance wireless technology, e.g. Bluetooth™, ZigBee, Wireless USB, or the like. To this end, the wireless interface 134 could include a Bluetooth™ antenna. Other wireless communication interfaces, e.g. WiFi, are also possible.

The electrical interface 136 of the main body 120 may include one or more electrical contacts. The electrical interface 136 may be located in, and in certain non-limiting embodiments at the bottom of, the aperture in the top end 122 of the main body 120. When the main body 120 is physically coupled to the consumable 150, the electrical interface 136 may be configured to pass electrical power from the power source 128 to (e.g. a heating device of) the consumable 150 when the smoking substitute device 110 is activated, e.g. via the electrical interface 160 of the consumable 150 (discussed below). When the main body 120 is not physically coupled to the consumable 150, the electrical interface may be configured to receive power from the charging station 6.

The additional components 138 of the main body 120 may include the optional light 126 discussed above.

The additional components 138 of the main body 120 may, if the power source 128 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 128 is a rechargeable battery, include a battery charging control circuit, for controlling the charging of the rechargeable battery. However, a battery charging control circuit could instead be located in the charging station 6 (if present).

The additional components 138 of the main body 120 may include an airflow sensor for detecting airflow in the smoking substitute device 110, e.g. caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less desired where the consumable 150 is intended to be disposed of after use, as in this example).

The additional components 138 of the main body 120 may include an actuator, e.g. a button. The smoking substitute device 110 may be configured to be activated when the actuator is actuated. This provides an alternative to the airflow sensor noted, as a mechanism for activating the smoking substitute device 110.

As shown in FIG. 3(*b*), the consumable 150 includes the tank 156, an electrical interface 160, a heating device 162, one or more air inlets 164, a mouthpiece 166, and, optionally, one or more additional components 168.

The electrical interface 136 of the main body 120 and an electrical interface 160 of the consumable 150 are configured to cooperate in a manner that electrically couples the main body 120 to the consumable 150. The electrical coupling may permit electrical power and, optionally, data to pass between the main body 120 and consumable 150. The electrical interface 160 of the consumable 150 may include one or more electrical contacts configured to physically contact the electrical interface 136 of the main body 120. In this way, electrical energy (e.g. in the form of an electrical current) is able to be supplied from the power source 128 in the main body 120 to the heating device 162 in the consumable 150.

In certain non-limiting embodiments, the heating device 162 is configured to heat e-liquid contained in the tank 156, e.g. using electrical energy supplied from the power source 128. In one example, the heating device 162 may include a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapour.

In certain non-limiting embodiments, the one or more air inlets 164 are configured to allow air to be drawn into the smoking substitute device 110, when a user inhales through the mouthpiece 166.

In use, a user activates the smoking substitute device 110, e.g. through actuating an actuator included in the main body 120 or by inhaling through the mouthpiece 166 as described above. Upon activation, the control unit 130 may supply electrical energy from the power source 128 to the heating device 162 (via electrical interfaces 136, 166), which may cause the heating device 162 to heat e-liquid drawn from the tank 156 to produce a vapour which is inhaled by a user through the mouthpiece 166.

Of course, a skilled reader would readily appreciate that the smoking substitute device 110 shown in FIGS. 2 and 3 shows just one example implementation of a smoking substitute device, and that other forms of smoking substitute device could be used as the smoking substitute device 10 of FIG. 1.

By way of example, a HNB smoking substitute device including a main body and a consumable could be used as the smoking substitute device 10 of FIG. 1, instead of the smoking substitute device 110. One such HNB smoking substitute device is the IQOS™ smoking substitute device discussed above.

As another example, an open system vaping device which includes a main body, a refillable tank, and a mouthpiece could be used as the smoking substitute device 10 of FIG. 1, instead of the smoking substitute device 110. One such open system vaping device is the blu PRO™ e-cigarette discussed above.

As another example, an entirely disposable (one use) smoking substitute device could be used as the smoking substitute device 10 of FIG. 1, instead of the smoking substitute device 110.

Embodiments of the present disclosure relate to the configuration and use of a network-enabled smoking substitute device such as that discussed above to permit monitoring of the location of the device relative to a mobile device with which it is connected. Where the mobile device possesses location tracking functionality, e.g. using GPS or the like, the current location of the mobile device may be used to influence the location monitoring function.

Figure 4:
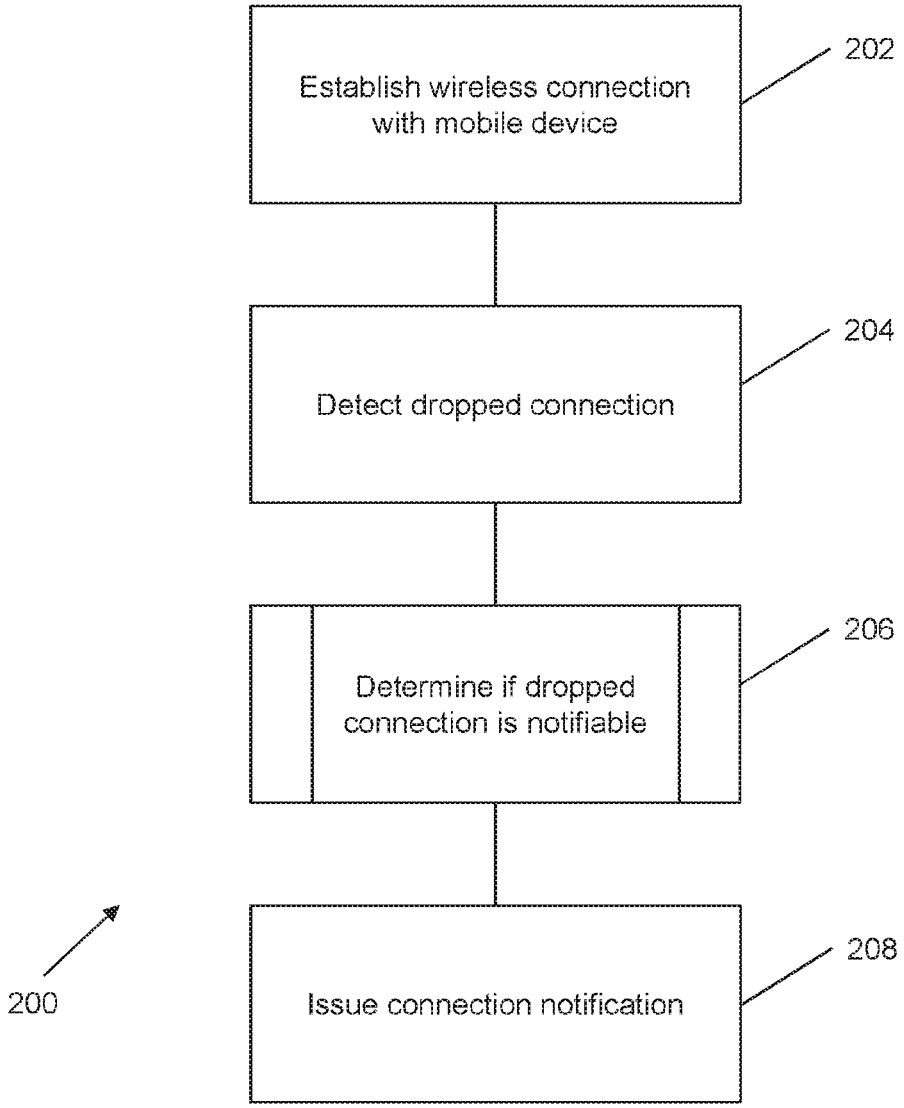
FIG. 4 is a flow chart of a location monitoring method that is an embodiment of the present disclosure.

FIG. 4 is a flow chart showing steps in a location monitoring method 200 that is an embodiment of the present disclosure. The method 200 begins with a step 202 of establishing a wireless connection between a smoking substitute device (such as the device 110 discussed above) and a mobile device (such as the mobile device 2 discussed above). The wireless connection may be via any suitable wireless protocol that permits transmission of information. For example, the smoking substitute device may pair with the mobile device using a short range transmission protocol such as Bluetooth™ or the like. The smoking substitute device may be wirelessly connectable to the mobile device via any suitable personal area network.

When the wireless connection is established, the smoking substitute device may be configured to share information with the mobile device, e.g. by transmitting data packets on a regular or ad hoc basis. The data packets may relate to usage of the device, e.g. to indicate an activation event for the heating element. The mobile device may run an app associated with the smoking substitute device. The app may be configured to run in the background on the mobile device, where it may receive and process the data packets. The app may build a profile of device usage based on the data packets as discussed below.

The app may be configured to monitor the wireless connection to the smoking substitute device. For example, the app may control the mobile device to poll the smoking substitute device on a regular, periodic or ad hoc basis to determine whether or not the wireless connection is still present. Polling can be suspending or interrupted during data transmission from the smoking substitute device. The mobile device may be configured as a master device of a wireless personal area network (e.g. Bluetooth piconet or the like), with the smoking substitute device being a slave unit associated with the network. Following initial registration, the mobile device and smoking substitute device may automatically pair on the wireless personal area network when connectivity is enabled on both devices and the smoking substitute device is within the wireless personal area network range, i.e. located within a certain distance of the mobile device.

In this arrangement, the presence of the connection thus implies that the smoking substitute device is at the same location as the mobile device. Conversely, a lost or dropped connection may indicate that the smoking substitute device is in a different location from the mobile device.

The method continues with a step 204 of detecting, by the app running on the mobile device, that the wireless connection between the smoking substitute device and mobile device has been lost. The lost connection may be detected in any conventional manner, e.g. where there is no detectable response to a polling request from the mobile device.

Upon detecting a dropped connection, the method continues with a step 206 of determining, by the app running on the mobile device, if the dropped connection is notifiable. The app is generally configured to utilize the mobile device to notify a user when a connection to the smoking substitute device is lost. The app can be configured to issue a notification every time the connection is lost. However, it can be recognized that there may be certain circumstances in which a user would be less concerned about a dropped connection. Moreover, in general it is desirable to avoid issuing an excessive number of notifications because (i) it can render them less effective (e.g. because a user gets into a habit of ignoring or cancelling them), (ii) it can be annoying for the user, and (iii) it wastes processing and power resources in the mobile device.

Accordingly, the app may be configured, and indeed may be configurable by a user, to ignore dropped connections in certain circumstances. In practice, the app may determine whether or not one or more notification suppression criteria are fulfilled upon detecting the dropped connection. The notification suppression criteria may relate to a variety of factors. For example, one criterion may be the duration for which the connection is dropped. In this example, the dropped connection may only be notifiable after a certain amount of time, or after a certain number of reconnection attempts. In another example, the a notification suppression criterion may relate to the existence of connections to one or more other smoking substitute devices. If a user possesses more than one smoking substitute device, it may not be necessary to notify a dropped connection to a specific device as long as a connection exists to another device.

The step 206 of determining whether or not to notify a dropped connection may make use of other functionality present on the mobile device. For example, the mobile device may be equipped with a location tracking unit (e.g. using GPS, assisted GPS, GSM localization or the like), so that is location can be determined. The step 206 of determining whether or not to notify a dropped connection may utilize a current location of the mobile phone. The notification suppression criteria may include a list (e.g. a preset or user-configurable list) of locations in which dropped connection notifications are suppressed. For example, a user may decide to suppress notifications when the mobile device is located at home or at their normal workplace.

The app may also be configured to utilize the location tracking unit in conjunction with usage data received from the smoking substitute device to create a map of usage locations. The map may be represented by a data structure that associates locations (from the location tracking unit) with usage information (i.e. number and/or time of activation events). The map may be stored locally (on the mobile device) and/or in the application server accessible by the mobile device via the app associated with the smoking substitute device. The step 206 of determining whether or not to notify a dropped connection may utilize the map of usage locations. For example, upon the detecting a dropped connection, the app use the current location of the mobile device (e.g. obtained from the location tracking unit) to query the map of usage locations to determine whether or not the current location is associated with historical use of the device. If the map indicates that there is no historical usage at the current location, the dropped connection notification may be suppressed or issued at a lower urgency level.

If the step 206 determines that the dropped connection is notifiable, the method continues with a step 208 of issuing a dropped connection notification. The notification may be visible, audible, tactile or a combination thereof. For example, the notification may cause the mobile device to vibrate and simultaneously display a banner with a message that is indicative of the dropped connection. The manner in which the notification is issued may be controlled by the user in a conventional manner. In one example, the app may be configured to send different types of notification depending on an urgency level associated with the notification. The step 206 of determining whether or not to notify a dropped connection may assign an urgency level to the notification based on the notification suppression criteria.

Figure 5:
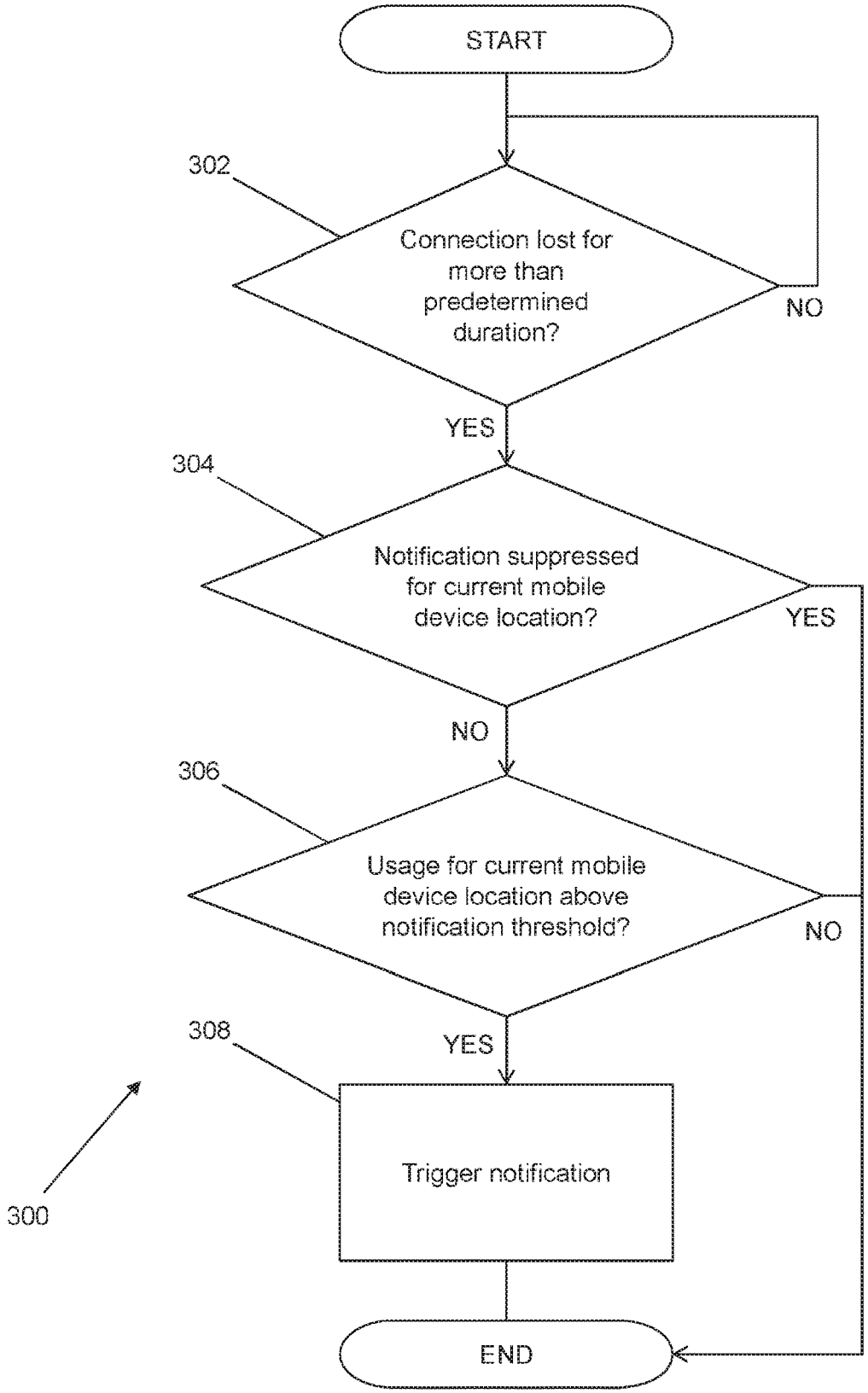
FIG. 5 is a flow chart of a notification determining process that can be used with the location monitoring method of FIG. 4.

FIG. 5 is a flow chart showing one example of a notification determining process 300 that can be used as the step 206 of determining whether or not to notify a dropped connection discussed above. It is to be understood that the notification suppression criteria used in this process represent only one example. In other embodiments, this process may include only one of these criteria, or may be arranged so that the criteria are judged independently so that a notification is suppressed if any one of the criteria are fulfilled.

The notification determining process 300 begins with a step 302 of judging whether or not the connection has been lost for more than a predetermined duration. The duration may be set based on a time period (e.g. 30 seconds) or a number of polling or reconnection requests (e.g. 10). If the predetermined duration has not passed, the process circles round.

If the predetermined duration has passed, the process moves to a step 304 of judging whether or not notifications are suppressed for the current mobile device location. The location may be called from a location tracking unit of the mobile device at this point, or may already have been obtained by the app running in the background. If notifications are suppressed for the current location, the process ends and no action is taken with respect to the dropped connection.

If notifications are not suppressed for the current location, the process moves to a step 306 of judging whether usage of the smoking substitute device at the current location is above a notification threshold. In this step, the map of usage locations may be called by the app. The current location may be matched to a location stored in the map to look up historical usage data for that location. The historical data may be compared to a threshold to determine whether or not to suppress the notification. For example, the map may indicate that a certain location is associated with a pattern (e.g. weekly or daily) of activation events. If the current location and time do not fit any pattern, the notification can be suppressed.

However, if the historical usage at the current location fits of matches with the timing of the dropped connection, the process moves to a step 308 of issuing the dropped connection notification, e.g. in the manner described above with respect to step 208.

Figure 6:
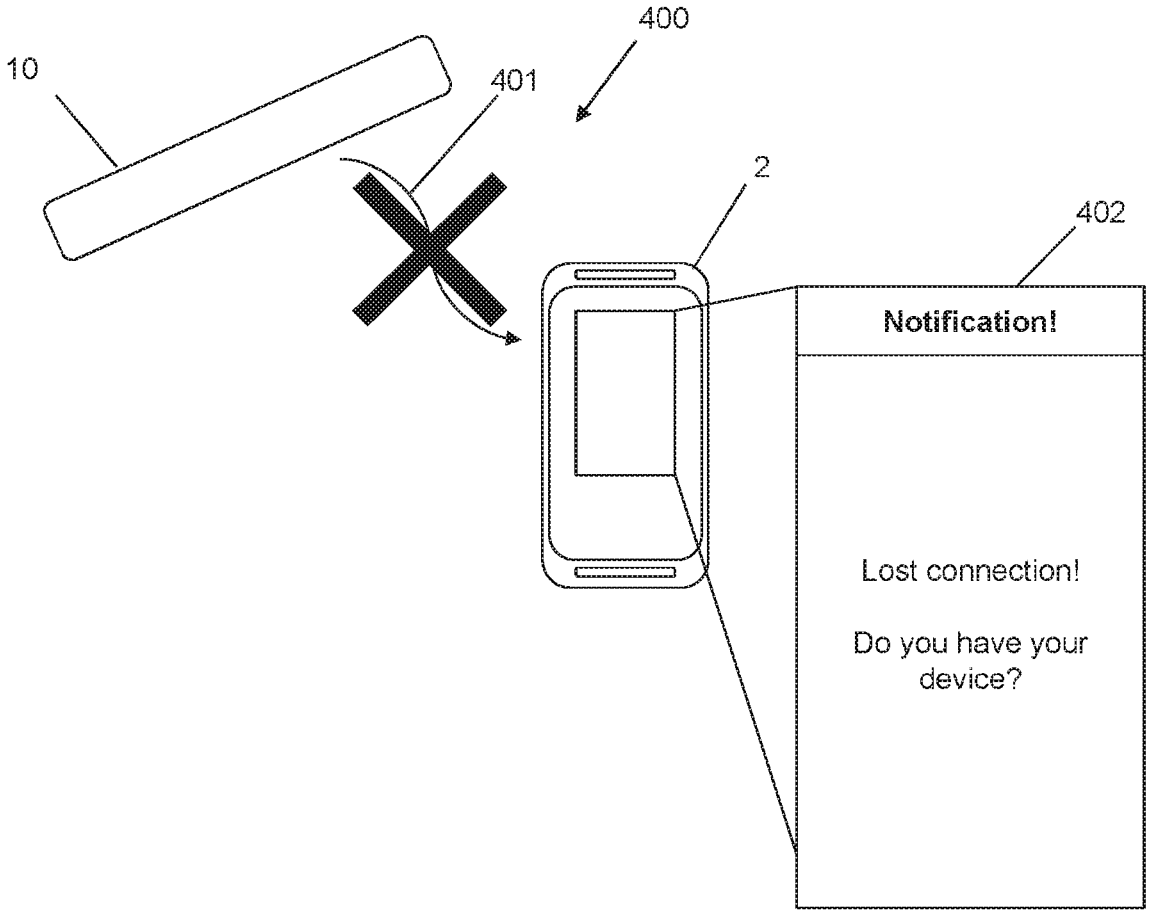
FIG. 6 is a schematic view of a location monitoring apparatus that is an embodiment of the present disclosure.

FIG. 6 is a schematic view of a location monitoring apparatus 400 that is an embodiment of the present disclosure when in use. The apparatus 400 comprises the mobile device 2 and smoking substitute device 10 discussed above. The smoking substitute device 10 is configured to be capable of wireless communication with the mobile device over a suitable short range network 401, over which it can transmit usage data as discussed above.

The mobile device 2 comprises a display screen as is conventional. The app may be configured to display a notification 402 on the display screen. The notification 402 may shown information indicative of a dropped connection to the smoking substitute device 10.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the present disclosure in diverse forms thereof.

While the present disclosure has been described in conjunction with the exemplary embodiments described above, many equivalent modifications and variations will be apparent to those skilled in the art when given this disclosure. Accordingly, the exemplary embodiments of the present disclosure set forth above are considered to be illustrative and not limiting. Various changes to the described embodiments may be made without departing from the spirit and scope of the present disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include," and variations such as "comprises," "comprising," and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The invention claimed is:

1. An apparatus for monitoring a smoking substitute device, the apparatus comprising:

a portable communication terminal configured to communicate with the smoking substitute device via a wireless communication channel and comprising a location tracking unit configured to determine a current location of the portable communication terminal, wherein the portable communication terminal is configured to:

poll the smoking substitute device on a periodic basis via the wireless communication channel;

automatically detect loss of a wireless connection between the portable communication terminal and the smoking substitute device based on a failure of the portable communication terminal to receive one or more responses from the smoking substitute device in response to the polling of the smoking substitute device;

automatically determine that a dropped connection notification for the loss of the wireless connection should be suppressed based on smoking substitute device notification suppression criteria being fulfilled, wherein the smoking substitute device notification suppression criteria comprises the current location of the portable communication terminal and historical smoking substitute device usage data of the smoking substitute device at the current location, wherein the historical smoking substitute device usage data comprises activation events of the smoking substitute device received via the wireless communication channel and accumulated over time; and suppress the dropped connection notification and thereby prevent unnecessary notifications being issued to avoid wasting power and processing resources.

2. The apparatus of claim 1, wherein the notification suppression criteria relate to any one or any combination of:

a duration of the loss of the wireless connection; and a presence of a wireless connection between the portable communication terminal and another smoking substitute device.

3. The apparatus of claim 1, wherein the portable communication terminal is configured to:

compare the current location with a stored list of locations at which notifications are to be suppressed; and suppress a dropped signal notification if the current location does not match a location on the stored list.

4. The apparatus of claim 1, wherein the portable communication terminal is configured to:

obtain, from the location tracking unit, a current location of the portable communication terminal upon detection of the loss of the wireless connection;

compare the obtained current location with a map of historical usage locations; and suppress a dropped signal notification if the current location does not match a location on the map of historical usage locations.

5. The apparatus of claim 4, further comprising the smoking substitute device, wherein the smoking substitute device comprises a wireless interface configured to transmit data to the personal communication terminal across the wireless communication channel, wherein, before the loss of the wireless connection, the smoking substitute device is configured to transmit to the portable communication terminal usage data, and wherein the portable communication terminal is configured to:

obtain, from the location tracking unit, location information corresponding to the usage data, and create the map of historical usage locations using the usage data and the corresponding location information.

6. The apparatus of claim 1, wherein the portable communication terminal is a mobile phone.

* * * * *